US011480164B2

(12) United States Patent
Mori et al.

(10) Patent No.: US 11,480,164 B2
(45) Date of Patent: Oct. 25, 2022

(54) VISCOUS MATERIAL SUPPLY DEVICE, COVER SHEET USED IN VISCOUS MATERIAL SUPPLY DEVICE, VISCOUS MATERIAL SUPPLY METHOD, AND METHOD FOR ATTACHING COVER SHEET

(71) Applicant: THREE BOND CO., LTD., Tokyo (JP)

(72) Inventors: Kenta Mori, Tokyo (JP); Shigeyuki Ohno, Tokyo (JP)

(73) Assignee: THREEBOND CO., LTD., Tokyo (JP)

( * ) Notice: Subject to any disclaimer, the term of this patent is extended or adjusted under 35 U.S.C. 154(b) by 80 days.

(21) Appl. No.: 16/485,534

(22) PCT Filed: Nov. 30, 2017

(86) PCT No.: PCT/JP2017/042942
§ 371 (c)(1),
(2) Date: Aug. 13, 2019

(87) PCT Pub. No.: WO2018/159043
PCT Pub. Date: Sep. 7, 2018

(65) Prior Publication Data

US 2020/0018299 A1 Jan. 16, 2020

(30) Foreign Application Priority Data

Feb. 28, 2017 (JP) ..... JP2017-037247

(51) Int. Cl.
*F04B 15/02* (2006.01)
*B05C 11/10* (2006.01)

(52) U.S. Cl.
CPC ..... *F04B 15/02* (2013.01); *B05C 11/10* (2013.01)

(58) Field of Classification Search
CPC .. F04B 15/00; F04B 15/02; F04B 9/12; F04B 9/123; F04B 53/143; B05C 11/1002;
(Continued)

(56) References Cited

U.S. PATENT DOCUMENTS 1,341,652 A * 6/1920 Lawrence ..... F16N 37/02 222/326
1,689,360 A * 10/1928 Monnot ..... F16N 37/02 141/357

(Continued)

FOREIGN PATENT DOCUMENTS

DE 3535369 A1 4/1986
DE 10 2004 016 006 A1 9/2005

(Continued)

OTHER PUBLICATIONS

International Search Report with English translation and Written Opinion dated Feb. 20, 2018 in corresponding International Application No. PCT/JP2017/042942; 11 pages.

(Continued)

*Primary Examiner* — Charles G Freay
*Assistant Examiner* — Chirag Jariwala
(74) *Attorney, Agent, or Firm* — Maier & Maier, PLLC

(57) ABSTRACT

To provide a viscous material supply device facilitating removal operation of viscous material that could be adhered to a platen, a covering sheet used in the viscous material supply device, and a viscous material supply method. A viscous material supply device can include a tank provided with a storage space storing viscous material; a piston slidably inserted into the tank, and is provided with a pressing surface that presses the viscous material and a suction passage through which the viscous material inside the tank flows by pressing force of the pressing surface; and a covering sheet including a covering part covering the pressing surface in the piston and a communication hole communicating with the suction passage.

2 Claims, 6 Drawing Sheets

(58) Field of Classification Search
CPC ..... B05C 17/00576; B21K 1/18; B23P 6/02; B23P 15/08; B23P 15/10; B29L 2031/7497; F16J 1/005; F16J 1/006; F16N 37/00; F16N 37/02
USPC ..... 29/888.04–888.51
See application file for complete search history.

(56) References Cited

U.S. PATENT DOCUMENTS

| | | | | | |
|---|---|---|---|---|---|
| 2,768,661 | A * | 10/1956 | Tyler | F16N 37/02 | 141/357 |
| 2,811,991 | A * | 11/1957 | Switzer | F16N 37/02 | 141/357 |
| 4,790,456 | A * | 12/1988 | Nakane | B67D 7/62 | 222/183 |
| 5,117,998 | A * | 6/1992 | Handzel | B67D 7/645 | 222/386 |
| 6,644,179 | B1 * | 11/2003 | Kiehm | A21C 11/00 | 241/169 |
| 2007/0039978 | A1 | 2/2007 | Scheugenpflug | | |
| 2009/0071981 | A1 * | 3/2009 | Scardino | F25D 3/08 | 222/146.6 |
| 2013/0056491 | A1 * | 3/2013 | Suzuki | B05B 9/047 | 222/95 |

FOREIGN PATENT DOCUMENTS

| | | | | |
|---|---|---|---|---|
| DE | 10 2007 003 972 | A1 | 7/2008 | |
| FR | 2750961 | A1 * | 1/1998 | B05C 17/00576 |
| FR | 2750961 | B1 | 9/1998 | |
| JP | S61-67873 | U | 5/1986 | |
| JP | S64-56877 | U | 4/1989 | |
| JP | H03-59070 | U | 6/1991 | |
| JP | H11-156282 | A | 6/1999 | |
| JP | 2001-301828 | A | 10/2001 | |
| JP | 2014122586 | A * | 7/2014 | F04B 15/02 |
| JP | 2014122586 | A | 7/2014 | |
| KR | 20-1989-0005050 | | 7/1988 | |
| WO | 2011/148735 | A1 | 12/2011 | |
| WO | 2014/097718 | A1 | 6/2014 | |

OTHER PUBLICATIONS

Chinese Office Action dated Nov. 4, 2020, in connection with corresponding CN Application No. 201780085664.4 (21 pp., including machine-generated English translation).
Indian Office Action dated Mar. 22, 2021, in connection with corresponding IN Application No. 201947034243; 5 pages.
Search Report dated Feb. 4, 2020 in corresponding European Application No. 17898451.4; 10 pages.
European Office Action dated Jul. 13, 2021, in connection with corresponding EP Application No. 17 898 451.4; 5 pages.
Office Action dated Aug. 30, 2021 in corresponding Chinese Application No. 201780085664.4; 12 pages including English-language translation.
Japanese Office Action dated Jul. 13, 2021, in connection with corresponding JP Application No. 2019-502460 (8 pp., including machine-generated English translation).
Office Action dated Apr. 9, 2021 in Chinese Application No. 201780085664.4; 20 pages including English-language translation.
Teng Yanxia et al., "Disease Nursing Routine and Application of Conventional Medical Devices", Part VIII Nursing and Conventional Medical Device, 2006, 7 pages including English-language translation.
Japanese Office Action dated Mar. 30, 2021, in connection with corresponding JP Application No. 2019-502460 (7 pp., including machine-generated English translation).
Hearing Notice Office Action dated Oct. 29, 2021, in corresponding Indian Application No. 201947034243; 2 pages including English-language translation.
Office Action dated Oct. 10, 2021, in corresponding Korean Application No. 10-2019-7022960; 12 pages including English-language translation.

* cited by examiner

VISCOUS MATERIAL SUPPLY DEVICE, COVER SHEET USED IN VISCOUS MATERIAL SUPPLY DEVICE, VISCOUS MATERIAL SUPPLY METHOD, AND METHOD FOR ATTACHING COVER SHEET

FIELD

The present invention relates to a viscous material supply device, a covering sheet used in the viscous material supply device, a viscous material supply method, and an attaching method of the covering sheet.

BACKGROUND

For example, in various machines such as automobiles and industrial machines, a device for ejecting a constant amount of viscous material from a nozzle of a dispenser and applying the viscous material on a predetermined portion is used in applying viscous material such as an adhesive or sealing material. In the device as such, there is installed a platen (hereinafter, referred to as a piston) which presses a container accommodating the viscous material and is provided with a flow passage for sucking the viscous material. Here, a technique is disclosed in which the piston is moved, and the viscous material is force-fed from the flow passage connected to the piston (refer to JP H11-156282 A).

CITATION LIST

Summary

In the above application device, the viscous material needs to be supplemented when all of the viscous material inside the container is finished to be force-fed. At this time, the piston is temporarily removed from the container. In supplementing the viscous material into the container, because the viscous material that had been force-fed from the previously used container is adhered on the piston, the viscous material adhered to the piston needs to be removed when the container is replaced to the new one. Regarding this point, the inventor has been intensively studying to improve an efficiency of removal operation of the viscous material that could be adhered to the piston.

Accordingly, an object of the present invention is to provide a viscous material supply device and a viscous material supply method that facilitate the removal operation of the viscous material that could be adhered to the piston.

The viscous material supply device according to an aspect of the present invention to solve the above problem includes a tank, a piston, and a covering sheet. The tank includes a storage space storing viscous material. The piston is slidably inserted into the tank, and the piston is provided with a pressing surface that presses the viscous material and a suction passage through which the viscous material inside the tank flows by pressing force of the pressing surface. The covering sheet includes a covering part covering the pressing surface in the piston and a communication hole communicating with the suction passage. Further, one aspect of the present invention is the covering sheet used in the viscous material supply device, and including the covering part that covers the pressing surface in the piston and the communication hole that communicates with the suction passage.

In the viscous material supply method according to one aspect of the present invention, the tank, the piston, and the covering sheet are prepared. Next, the covering sheet is attached to the piston such that the covering part of the covering sheet covers the pressing surface of the piston and the communication hole of the covering sheet communicates with the suction passage of the piston. Thereafter, the viscous material is pressed by the pressing surface of the piston, and the viscous material is flowed through the suction passage. Further, one aspect of the present invention is an attaching method of the covering sheet. In the method, there are prepared the piston in which the pressing surface and the suction passage are provided, and the covering sheet including the covering part and the communication hole. Then, the covering sheet is attached to the piston such that the covering part of the covering sheet covers the pressing surface of the piston and the communication hole of the covering sheet communicates with the suction passage of the piston.

DETAILED DESCRIPTION

Figure 1:
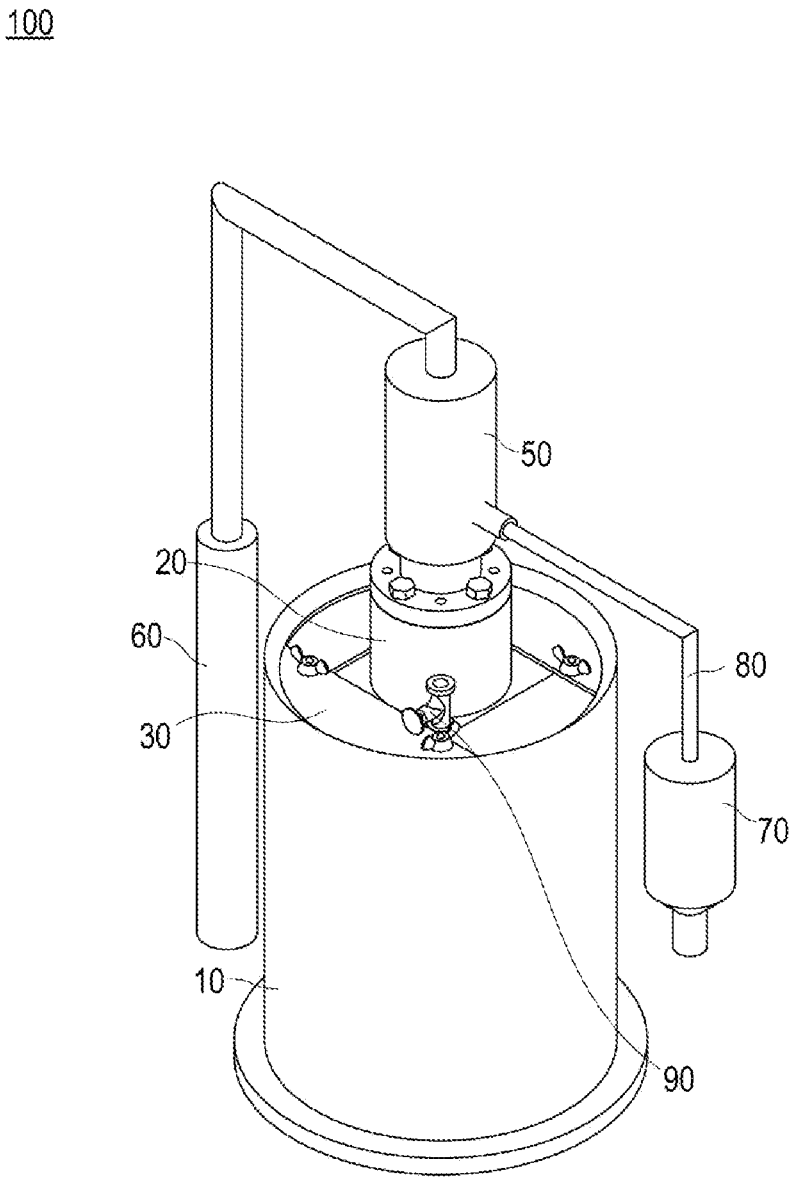
FIG. 1 is a perspective view showing a viscous material supply device according to one embodiment of the present invention.

Hereinafter, an embodiment of the present invention is described with reference to the attached drawings. Note that the following description does not limit the technical scope and the meaning of the term recited in claims. Moreover, dimensional proportions in the drawings are exaggerated for convenience of description, and may differ from the actual proportion.

(Viscous material supply device)

FIG. 1 to FIG. 6 are drawings provided for describing a viscous material supply device according to one embodiment of the present invention.

The viscous material supply device 100 according to the present embodiment is used for discharging and supplying viscous material. The viscous material supply device 100 applies grease, an adhesive, a liquid gasket such as an FIPG (Formed In Place Gasket), sealing material, or other viscous material, as an object to be applied, in a manufacturing process, maintenance and the like of a machine such as an automobile or industrial machine.

Here, the viscous material is viscous material that has fluidity but whose viscosity is relatively low and flow resistance to a pipeline and a nozzle is relatively low, and for example, includes grease, an adhesive, a liquid gasket such as FIPG, sealing material, and the like. A preferable viscosity of the viscous material is 200 Pa·s or less. In the following description, a case is described in which a silicone-based gasket that is moisture-cured by a condensation reaction in the atmosphere is used as an example of the viscous material. However, the present invention is not limited to the above.

Figure 2:
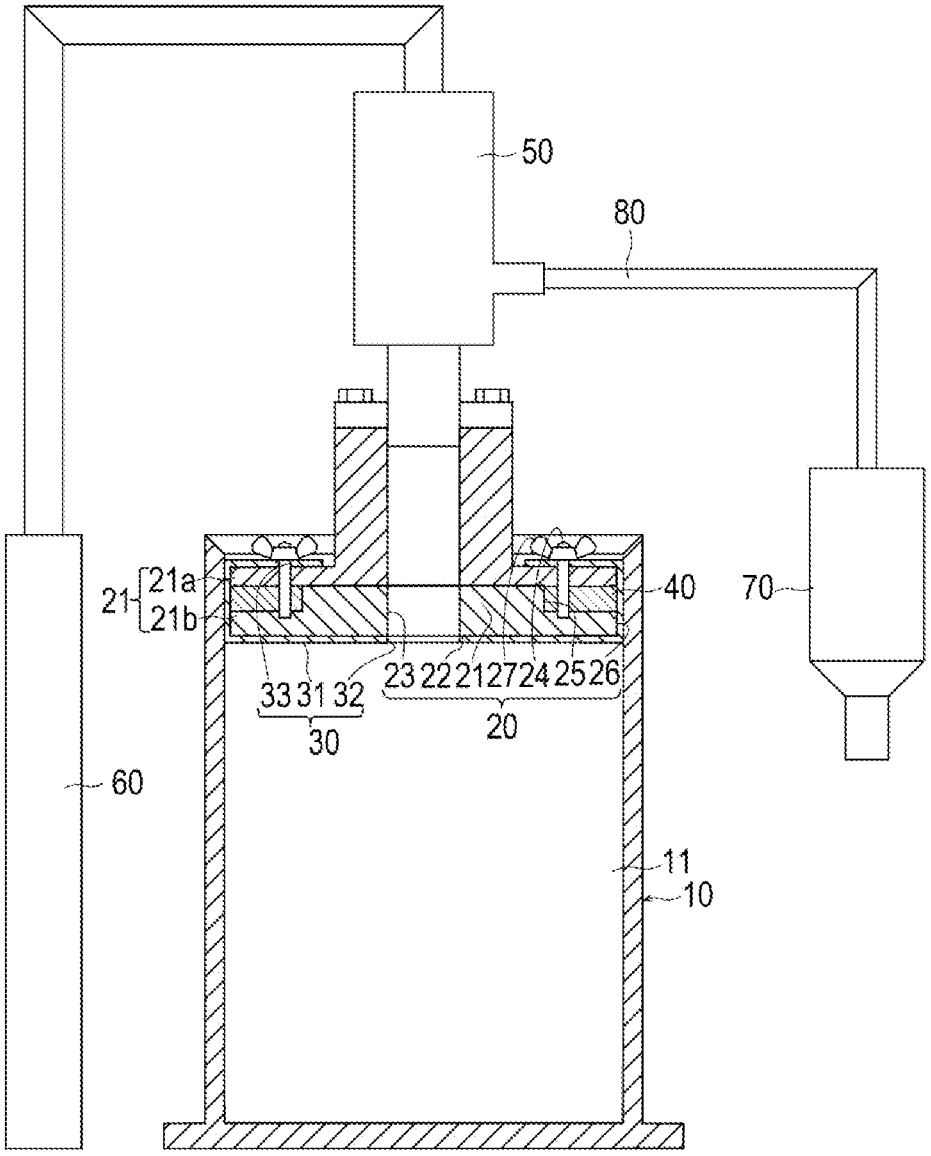
FIG. 2 is a cross-sectional view showing the viscous material supply device.

The viscous material supply device 100 according to the present embodiment includes, as shown in FIGS. 1 and 2, a tank 10, a piston 20, a covering sheet 30, a sealing member 40, a pump 50, an air cylinder 60, a dispenser 70, a pipeline 80, and an air bleeding valve 90. The detailed description is made below.

(Tank)

The tank 10 has, as shown in FIG. 2, a storage space 11 storing the viscous material. The tank 10 is a member formed in a cylindrical shape and made of plastic such as polyethylene, polypropylene, ethylene-vinyl acetate copolymer, polyethylene terephthalate, polyamide, or made of metal, and is constituted by having an upper part of the cylindrical shape opened so as to allow the viscous material to be accommodated. However, the shape of the tank 10 is not limited to a cylinder as long as the viscous material can be stored, and other than the above shape, can be formed in, for example, a shape of a polygonal column such as a square column or hexagonal column. Also, the shape is not necessarily cylinder or polygonal column, as long as the tank 10 is stably installed on the ground. In the present embodiment, the viscous material is directly accommodated in the tank 10 without interposing a bag or the like.

(Piston)

The piston 20 is slidably inserted inside the tank 10. The piston 20 has, as shown in FIG. 2, a main body part 21, a pressing surface 22, a suction passage 23, pins 24, a first outer shape part 25, a second outer shape part 26, and nuts 27.

The main body part 21 has, as shown in FIG. 2, a plate member 21*a* and a plate member 21*b*. The plate member 21*a* is constituted of a shape formed by combining a small-diameter cylinder and a large-diameter cylinder. Although different in sizes, similarly to the plate member 21*a*, the plate member 21*b* is constituted of a shape formed by combining a small-diameter cylinder and a large-diameter cylinder. The plate member 21*a* and the plate member 21*b* are integrally constituted by the pins 24 and the nuts 27. However, a specific shape of the main body part 21 is not limited to the above as long as the main body part 21 can be slidably inserted inside the tank 10 and can press the viscous material stored inside the tank 10.

The first outer shape part 25 is, as shown in FIG. 2, a portion of the small-diameter cylinder in the plate member 21*b*, whose outer diameter (outer shape) is constituted smaller than that of the second outer shape part 26. The second outer shape part 26 is a portion of the large-diameter cylinder in the plate member 21*b*, and is separated from the first outer shape part 25 downward in FIG. 2 in a direction that the piston 20 slides, and has an outer periphery constituted larger than the first outer shape part 25. On an outer periphery of the first outer shape part 25, the sealing member 40 having a disc shape is attached. The large-diameter portion of the cylinder in the plate member 21*a* and the second outer shape part 26 in the plate member 21*b* have outer diameters formed substantially the same as shown in FIG. 2, however, the configuration is not limited to this.

The pressing surface 22 is a portion that presses the viscous material in the piston 20. As shown in FIG. 2, the pressing surface 22 refers to an end surface in an axial direction of the second outer shape part 26 in the plate member 21*b* of the main body part 21. The pressing surface 22 refers to a portion in the radial direction from the outer periphery of the second outer shape part 26 of the plate member 21*b* to an outer periphery of the suction passage 23, and is formed in a substantially disc shape.

The suction passage 23 is a portion where the viscous material inside the tank 10 flows through by pressing by the pressing surface 22. As shown in FIG. 2, the suction passage 23 is formed by hollowing out the main body part 21 at an axis center portion located at an inner part in the radial direction. In the present embodiment, the suction passage 23 has a substantially circular cross-sectional shape, however, the cross-sectional shape is not limited to the above as long as the viscous material can be flowed through. The pipeline 80 is connected to the piston 20, and the pipeline 80 communicates with the suction passage 23. The viscous material stored in the storage space 11 of the tank 10 flows into the suction passage 23 by pressing of the pressing surface 22, and thereafter, flows into the pipeline 80.

The pins 24 are erected on a surface opposite to the pressing surface 22 in the axial direction of the piston 20 as shown in FIG. 2, and the covering sheet 30 is attached to the piston 20. In the present embodiment, the pins 24 are erected with uniform angular intervals at four locations for every 90 degrees in a circumferential direction (angular direction), in plan view from the axial direction of the piston 20. However, numbers, locations to be attached, and the angular intervals of the pins 24 are not limited to the above as long as the covering sheet 30 can be attached to the piston 20, and the pins 24 are not necessarily arranged uniformly in the angular direction (circumferential direction). Additionally, the pin 24 is formed with a screw portion and is screwed with the nut 27. However, the configuration is not limited to this, and as long as the covering sheet 30 can be attached to the piston 20, the screw portion and the nut 27 are not necessarily provided.

(Covering Sheet)

Figure 3:
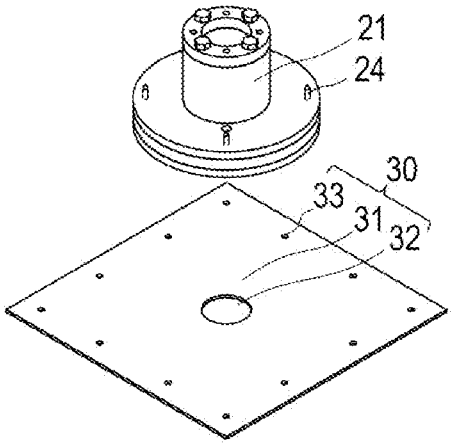
FIG. 3 is a perspective view showing a case of attaching a covering sheet to a piston.

The covering sheet 30 has, as shown in FIG. 2 and FIG. 3, a covering part 31, a communication hole 32, and insertion holes 33.

The covering part 31 covers the pressing surface 22 in the piston 20. More specifically, the covering part 31 covers the pressing surface 22 being an end surface in the axial direction of the second outer shape part 26 of the plate member 21*b* of the piston 20. With this configuration, the viscous material can be prevented from being adhered to the pressing surface 22 of the piston 20 after being force-fed from the tank 10, thereby facilitating removal operation of removing the viscous material from the piston 20. Material of the covering sheet 30 is not particularly limited, but polyethylene, polypropylene, and the like are exemplified.

The communication hole 32 communicates with the suction passage 23 of the piston 20 when the covering sheet 30 is attached to the piston 20. The communication hole 32 is formed in a substantially circular shape similarly to the suction passage 23.

Figure 4:
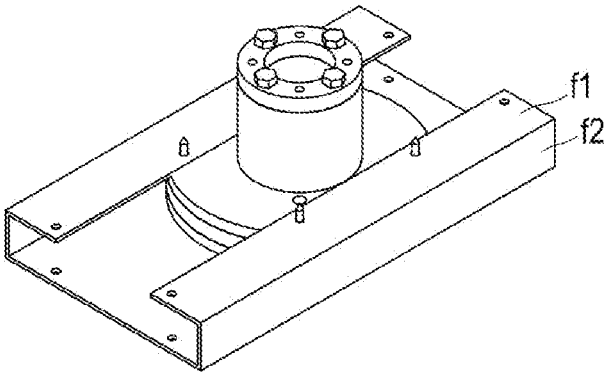
FIG. 4 is a perspective view showing, in continuation of FIG. 3, the case of attaching the covering sheet to the piston.
Figure 5:
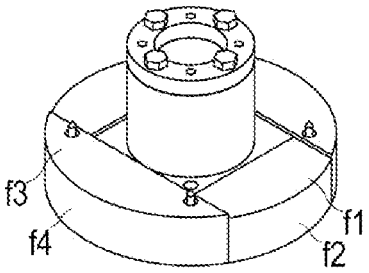
FIG. 5 shows a modified example of the embodiment and is a perspective view showing, in continuation of FIG. 4, the case of attaching the covering sheet to the piston.

The insertion holes 33 are provided at a relatively outer part in the radial direction of the covering sheet 30. The covering sheet 30 is, as shown in FIGS. 4 and 5, folded from a state of being located on a side of the pressing surface 22 to a state such that the outer periphery of the covering sheet 30 is on a side opposite to the pressing surface 22. The insertion holes 33 are fitted with the pins 24 of the piston 20 at portions of the covering sheet 30 being folded. With this configuration, axis centers of the suction passage 23 of the piston 20 and the communication hole 32 of the covering sheet 30 match with each other.

The covering sheet 30 is formed in a substantially rectangular shape in plan view, however, the shape is not limited to the above as long as the pressing surface 22 of the piston 20 is covered, and apart from the above, may have a circular shape or the like.

(Sealing Member)

The sealing member 40 is formed in a cylindrical shape with a substantially disc-shaped cross-section, and is attached to the outer periphery of the first outer shape part 25 of the plate member 21*b* of the piston 20. The sealing member 40 seals a portion between the piston 20 and the tank 10 by being attached at the above position. Material of the sealing member 40 is not particularly limited as long as the portion between the piston 20 and the tank 10 can be sealed, but NBR (nitrile butadiene rubber), acrylic rubber, chloroprene rubber, fluoro-rubber, polyurethane, and the like are exemplified, and the material is selected according to the viscous material.

(Other Constituent Elements)

The pump 50 is not particularly limited as long as the pump can force-feed the viscous material pushed out from the tank 10 to the dispenser 70 and the like, and for example, a gear pump, a plunger pump, a screw pump, a piston pump, and the like are exemplified.

The air cylinder 60 is provided to drive the piston 20 from an opening part of the tank 10 toward a bottom part of the same by air pressure. The dispenser 70 is constituted of known components including a syringe, a plunger that can move within the syringe, and the like.

The pipeline 80 is provided from the piston 20 through the pump 50 to the dispenser 70, and the viscous material flows through the pipeline 80. A cross-sectional shape of the pipeline 80 is formed in a substantially disc hollow shape, however, the shape is not limited to this. The air bleeding valve 90 switches opening/closing between the storage space 11 of the tank 10 and the outside in a state in which the piston 20 is inserted in the storage space 11 of the tank 10.

(Viscous Material Supply Method and Attaching Method of Covering Sheet)

Figure 6:
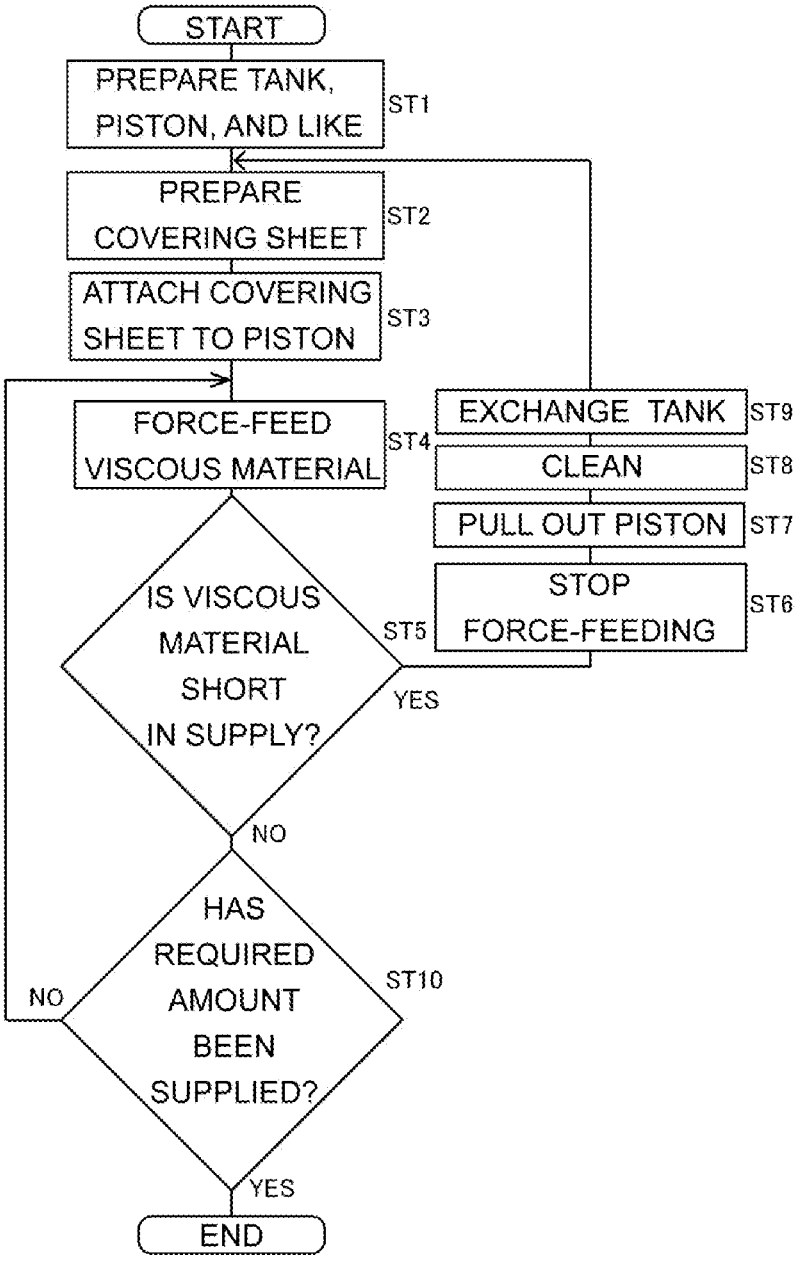
FIG. 6 is a flowchart showing a viscous material supply method according to one embodiment of the present invention.

Next, a viscous material supply method and an attaching method of covering sheet 30 are described. FIG. 6 is a flowchart showing the viscous material supply method according to one embodiment of the present invention. In the viscous material supply method, generally, the tank 10, the piston 20, the covering sheet 30, and the like are prepared (ST1, 2). Next, the covering sheet 30 is attached to the piston 20 (ST3). Thereafter, the viscous material is pressed by the pressing surface 22 of the piston 20 to force-feed the viscous material into the suction passage 23 (ST4). Further, the attaching method of the covering sheet 30 includes, in ST2, ST3 of FIG. 6, preparing the piston 20 and the covering sheet 30, and attaching the covering sheet 30 to the piston 20. The detailed description is made below.

First, the components from the tank 10 through the air bleeding valve 90 required in supplying the viscous material are prepared (ST1, ST2). At this time, the tank 10 is filled with the viscous material in advance. Next, the sealing member 40 is attached to the piston 20.

Next, as shown in FIG. 3, the covering sheet 30 is arranged on the side of the pressing surface 22 of the piston 20. Then, as shown in FIG. 4, an inner periphery in the covering part 31 is abutted to the pressing surface 22 of the piston 20, and portions opposing to each other at an outer periphery of the covering sheet 30 are folded back toward the side opposite to the pressing surface 22 with an outer peripheral edge part of the second outer shape part 26 of the piston 20 as an origin. Then, the insertion holes 33 of the covering sheet 30 are fitted with the pins 24 of the piston 20.

Accordingly, folded-back parts f1, f2 are formed as shown in FIG. 4. Next, the insertion holes 33 of the covering sheet 30 are fitted with the pins 24 of the piston 20. Accordingly, the suction passage 23 of the piston 20 and the communication hole 32 of the covering sheet 30 communicate with each other and the axis centers of the suction passage 23 and the communication hole 32 match with each other. Note that "matching" of the suction passage 23 and the communication hole 32 herein allows to have positional shift of about 2, 3 mm. The piston 20 and the covering sheet 30 can be inserted into the tank 10 in this state. Also, in this state, the folded-back parts f2 of the covering sheet 30 are positioned further outward in the radial direction than the sealing member 40. In other words, the sealing member 40 comes into contact with the tank 10 while having the covering sheet 30 interposed therebetween.

Note that the covering sheet 30 can be attached to the tank 10 in a state of having the folded-back parts f1, f2 formed, however, the following procedure can be taken following FIG. 4. That is, as shown in FIG. 5 following FIG. 4, portions that have not been folded back at the outer periphery of the covering sheet 30 are folded back toward the side opposite to the pressing surface 22 with the outer peripheral edge part of the second outer shape part 26 of the piston 20 as an origin. Then, the insertion holes 33 of the covering sheet 30 which have not been fitted with the pins 24 in FIG. 4 may be fitted with the pins 24 of the piston 20. Accordingly, folded-back parts f3, f4 are formed.

When the covering sheet 30 is successfully attached to the piston 20, the piston 20, the air cylinder 60, the pump 50, and the dispenser 70 are connected. Thereafter, the piston 20 is driven by the air cylinder 60 and is pushed inside the storage space 11 of the tank 10, and the viscous material is flowed through the suction passage 23 and the pipeline 80 by activating the pump 50 and is supplied from the dispenser 70 (ST4).

Here, when the viscous material becomes short in supply (ST5: YES), operations of the pump 50 and the air cylinder 60 are stopped and the supply of the viscous material is stopped (ST6). Then, the piston 20 is pulled out from the tank 10 (ST7). Further, the pump 50 and the piston 20 are separated, and the covering sheet 30 is removed from the piston 20. Because the viscous material is adhered to the suction passage 23 of the piston 20, cleaning is performed (ST8). The pressing surface 22 of the piston 20 is covered by the covering part 31 of the covering sheet 30, therefore, does not require cleaning, and the cleaning operation is correspondingly facilitated. Next, the tank 10 is replaced with the new one having the viscous material therein (ST9).

When the cleaning of the piston 20 and the replacement of the tank 10 are finished, the covering sheet 30 is replaced with the new one (ST2). Then, the attaching of the covering sheet 30 to the piston 20 (ST3) and force-feeding of the viscous material (ST4) are repeated.

When the viscous material is not short in supply in the storage space 11 of the tank 10 (ST5: NO), and a required amount of the viscous material has not been supplied (ST10: NO), the supply of the viscous material is continued (ST4).

As described above, the viscous material supply device 100 according to the present embodiment includes the tank 10, the piston 20, and the covering sheet 30. The tank 10 is provided with a storage space 11 storing the viscous material. The piston 20 is slidably inserted into the tank 10, and the piston 20 is provided with the pressing surface 22 that presses the viscous material, and a suction passage 23 through which the viscous material inside the tank 10 flows by pressing force of the pressing surface 22. The covering sheet 30 includes the covering part 31 that covers the pressing surface 22 in the piston 20, and the communication hole 32 that communicates with the suction passage 23.

Further, in the viscous material supply method according to the present embodiment, the tank 10, the piston 20, and the covering sheet 30 are prepared. Next, the covering sheet 30 is attached to the piston 20 such that the covering part 31 of the covering sheet 30 covers the pressing surface 22 of the piston 20, and the communication hole 32 of the covering sheet 30 communicates with the suction passage 23 of the piston 20. Thereafter, the viscous material is pressed by the pressing surface 22 of the piston 20, and the viscous material is flowed through the suction passage 23. Further, in the attaching method of the covering sheet 30 to the piston 20, the piston 20 and the covering sheet 30 are prepared. Then, the covering sheet 30 is attached to the piston 20 such that the covering part 31 of the covering sheet 30 covers the pressing surface 22 of the piston 20 and the communication hole 32 of the covering sheet 30 communicates with the suction passage 23 of the piston 20.

Accordingly, the pressing surface 22 of the piston 20 is covered by the covering part 31 of the covering sheet 30, preventing the viscous material to be adhered to the pressing surface 22, and correspondingly, the removal operation of the viscous material in the piston 20 can be facilitated.

Additionally, in the piston 20, the pins 24 for attaching the covering sheet 30 to the piston 20 are erected on the surface on the side opposite to the pressing surface 22. The covering sheet 30 includes the insertion holes 33 that are fitted with, when outer portions of the covering part 31 are folded back toward the side opposite to the pressing surface 22, the pins 24 at the folded back portions. The covering sheet 30 is arranged on the side of the pressing surface 22 of the piston 20, and an inner part (inner side) of the covering sheet 30 is abutted to the pressing surface 22 of the piston 20. The outer parts (outer sides) of the covering part 31 are folded back to the side opposite to the side of the pressing surface 22 of the piston 20, and the insertion holes 33 are fitted with the pins 24 of the piston 20. As described above, by fitting the insertion holes 33 with the pins 24 of the piston 20, the axis centers of the suction passage 23 and the communication hole 32 of the covering sheet 30 match with each other.

Figure 7:
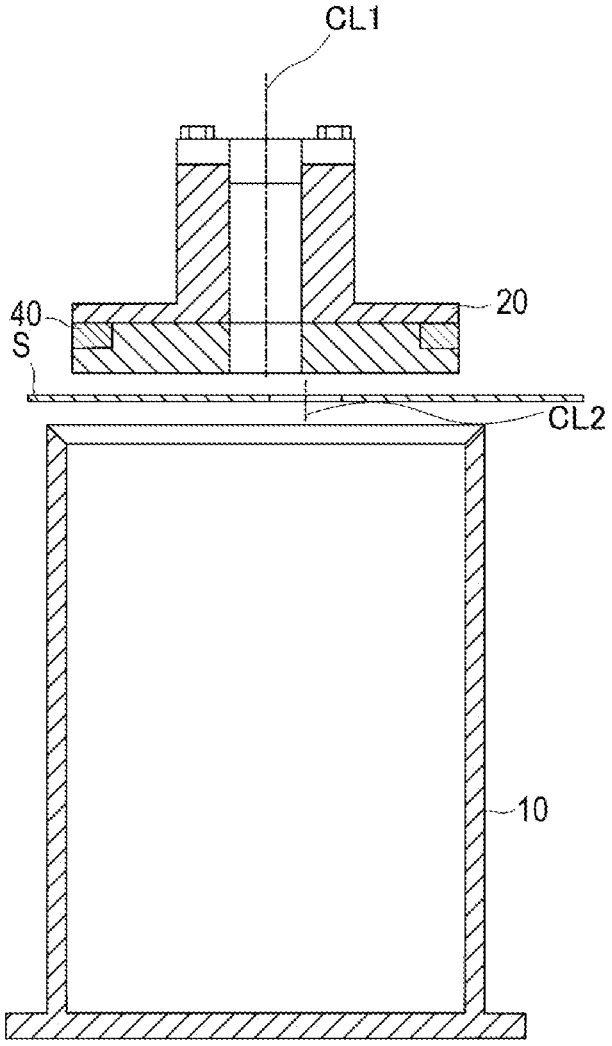
FIG. 7 is a cross-sectional view according to a comparative example of FIG. 2.

FIG. 7 is a cross-sectional view according to a comparative example similar to FIG. 2. As in a case of the comparative example of FIG. 7, in a case in which a suction passage and a communication hole are aligned with each other in a state where pins 24 are not provided in the piston 20 and a covering sheet S does not have insertion holes, an operator needs to visually align an axis center CL1 of the suction passage and an axis center CL2 of the communication hole. On the other hand, the viscous material supply device 100 of the present embodiment is configured as described above, therefore, the aligning of the suction passage 23 and the communication hole 32 can be simplified. Moreover, accuracy of the aligning can be improved as compared to that performed visually. Further, when the axis centers of the communication hole 32 of the covering sheet 30 and the suction passage 23 do not match with each other, the suction passage 23 may be at least partially covered by the covering sheet 30 to obstruct the force-feeding of the viscous material, causing a risk that the viscous material remains in the storage space 11 of the tank 10. On the other hand, by matching the axis centers of the communication hole 32 and the suction passage 23 by the pins 24 and the insertion holes 33 as described above, the above situation can be prevented and the risk of the viscous material remaining in the storage space 11 can be suppressed or reduced.

Additionally, the sealing member 40 for sealing the portion between the piston 20 and the tank 10 is attached at the outer periphery of the first outer shape part 25 of the piston 20. The sealing member 40 is attached to an outer part of the first outer shape part 25 in the radial direction of the piston 20 before the viscous material is flowed through the suction passage 23 by the pressing surface 22 of the piston 20. Accordingly, when the viscous material inside the tank 10 is pressed by the piston 20, leaking of the viscous material from the outer periphery of the piston 20 can be prevented.

Figure 8:
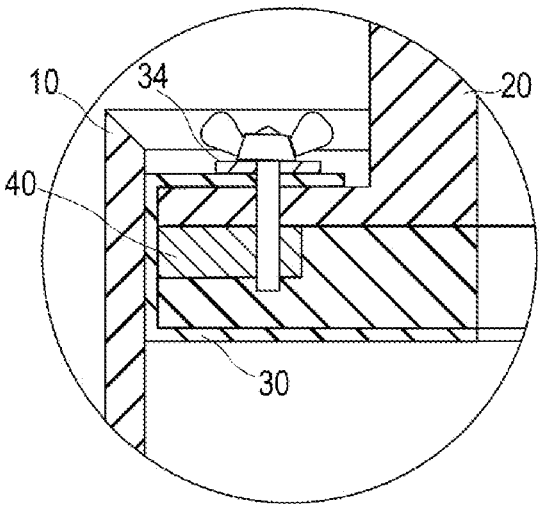
FIG. 8 is a partial enlarged view showing a vicinity of an outer periphery of the piston in the cross-sectional view of FIG. 2 and showing a modified example of FIG. 2.

Note that the present invention is not limited to the above-described embodiment, but various changes can be made within the scope of the claims. FIG. 8 is a partial enlarged view showing a modified example of FIG. 2. In the above, it has been described that the outer periphery of the covering sheet 30 is folded back toward the side opposite to the pressing surface 22, and the insertion holes 33 are fitted with the pins 24, however, the configuration is not limited to this.

Apart from the above, an edge part of the insertion hole 33 in the covering sheet 30 may be provided with, as shown in FIG. 8, a reinforcing member 34 for increasing a thickness at the edge part of the insertion hole 33. The reinforcing member 34 is applied with an adhesive on a side facing (side coming into contact with) the covering sheet 30, and thereby, is constituted integrally with the covering sheet 30. With this configuration, when tension is applied in the covering sheet 30 at the pressing surface 22 and the side opposite thereto, deformation of the outer peripheral edge part of the insertion hole 33 and moreover, positional shift of the communication hole 32 can be prevented.

Figure 9:
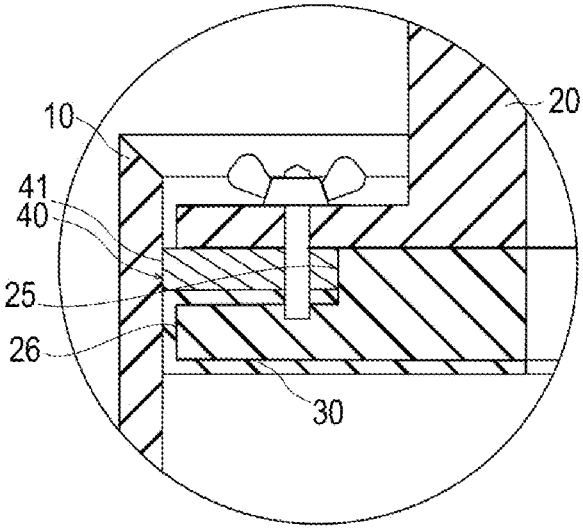
FIG. 9 is a partial enlarged view showing the vicinity of the outer periphery of the piston in the cross-sectional view of FIG. 2 and showing the modified example of FIG. 2.

Further, the embodiment is described in which, in the above, the sealing member 40 comes into contact with the tank 10 while having the covering sheet 30 interposed therebetween, however, the configuration is not limited to this. Apart from the above, as shown in FIG. 9 as well, an outside surface 41 of the sealing member 40 may be positioned further outward in the radial direction than the covering sheet 30 attached to the piston 20 at the first outer shape part 25. In this case, when attaching the sealing member 40 to the piston 20, the outside surface 41 of the sealing member 40 is positioned further outward in the radial direction than the covering sheet 30 at the first outer shape part 25.

The covering sheet 30 is attached to the piston 20 before the sealing member 40 is attached to the piston 20. That is, the covering sheet 30 is arranged on the side of the pressing surface 22, the inner periphery of the covering part 31 is abutted to the pressing surface 22, and the outer periphery of the covering part 31 is folded back to the side opposite to the pressing surface 22 with the outer peripheral edge part of the second outer shape part 26 of the piston 20 as an origin. Thereafter, the insertion holes 33 are fitted with the pins 24. Accordingly, the axis centers of the suction passage 23 and the communication hole 32 match with each other. The sealing member 40 is then attached to the piston 20.

With this configuration, the sealing member 40 is positioned on the outer periphery further than the covering sheet 30 at the first outer shape part 25, allowing the sealing member 40 to come into contact with the tank 10 without interposing the covering sheet 30. Accordingly, a portion between the piston 20 and the tank 10 can be more firmly sealed.

Further, the embodiment in which the viscous material is directly filled in the storage space 11 of the tank 10 has been described above, however, the configuration is not limited to this. Apart from the above, not only the viscous material but also a bag that accommodates the viscous material may be accommodated together in the storage space 11 of the tank 10.

Note that the present application is based on Japanese Patent Application No. 2017-037247 filed on Feb. 28, 2017, and the entire contents of which is incorporated by reference.

REFERENCE SIGNS LIST

10 tank
100 viscous material supply device
20 piston
22 pressing surface
23 suction passage
24 pin
25 first outer shape part
26 second outer shape part
30 covering sheet
31 covering part
32 communication hole
33 insertion hole
34 reinforcing member
40 sealing member
41 outside surface
50 pump

The invention claimed is:

1. A viscous material supply device comprising:

a tank provided with a storage space storing viscous material;

a piston slidably inserted into the tank, the piston provided with a pressing surface that presses the viscous material and a suction passage through which the viscous material inside the tank flows by pressing force of the pressing surface; and a covering sheet including a covering part covering the pressing surface in the piston and a communication hole communicating with the suction passage, pins erected on a side opposite to the pressing surface in the piston that attach the covering sheet to the piston, and a sealing member attached to an outer periphery of the piston and sealing a portion between the piston and the tank;

wherein the covering sheet is folded back at an outer periphery toward the side opposite to the pressing surface and including insertion holes fitted with the pins of the piston at a portion that is folded back, and axis centers of the suction passage and the communication hole of the covering sheet are matched with each other by fitting the insertion holes with the pins of the piston and the piston further includes a first outer shape part on which the sealing member is attached and a second outer shape part separated from the first outer shape part in a direction that the piston slides, an outer periphery of the second outer shape part is formed larger than an outer periphery of the first outer shape part, and the sealing member has an outside surface positioned further outward in a radial direction than a portion of the covering sheet in the vicinity of the first outer shape part, the covering sheet is replaced after cleaning the piston and replacing the tank and the pins are inserted into the sealing member.

2. A viscous material supply method, comprising:

preparing a tank provided with a storage space storing viscous material, a piston slidably inserted into the tank, the piston provided with a pressing surface that presses the viscous material and a suction passage through which the viscous material inside the tank flows by pressing force of the pressing surface, and a covering sheet including a covering part covering the pressing surface in the piston and a communication hole communicating with the suction passage;

attaching the covering sheet to the piston such that the covering part of the covering sheet covers the pressing surface of the piston and the communication hole of the covering sheet communicates with the suction passage of the piston; and attaching a sealing member that seals a portion between the piston and the tank outward in a radial direction of the piston to the piston before the viscous material is flowed through the suction passage by the pressing surface of the piston; and pressing the viscous material by the pressing surface of the piston, and flowing the viscous material through the suction passage, wherein pins are erected on a side opposite to the pressing surface in the piston, and covering part of the covering sheet is provided with insertion holes, the method comprising:

when attaching the covering sheet to the piston, arranging the covering sheet on a side of the pressing surface of the piston; abutting an inner part in the covering part of the covering sheet to the pressing surface of the piston; folding back outer parts in the covering part of the covering sheet to the side opposite to the pressing surface of the piston; and fitting the insertion holes of the covering sheet with the pins of the piston so that the pins are inserted into the sealing member and the piston is provided with a first outer shape part on which the sealing member is attached, and a second outer shape part separated from the first outer shape part in a direction that the piston slides, an outer periphery of the second outer shape part is formed larger than an outer periphery of the first outer shape part, the method comprising when the sealing member is attached to the piston, positioning an outside surface of the sealing member further outward in the radial direction than a portion of the covering sheet in the vicinity of the first outer shape part, and the covering sheet is replaced after cleaning the piston and replacing the tank.

* * * * *